US006223999B1

(12) United States Patent
Lemelshtrich et al.

(10) Patent No.: US 6,223,999 B1
(45) Date of Patent: May 1, 2001

(54) STATIC SPRINKLER WITH PRESETTABLE WATER DISCHARGE PATTERN

(75) Inventors: Noam Lemelshtrich, Caesarea; Yoram Hadar, Natania, both of (IL)

(73) Assignee: Lego Irrigation Ltd., Natania (IL)

( * ) Notice: Subject to any disclaimer, the term of this patent is extended or adjusted under 35 U.S.C. 154(b) by 0 days.

(21) Appl. No.: 09/154,034

(22) Filed: Sep. 16, 1998

Related U.S. Application Data

(63) Continuation of application No. PCT/IL97/00098, filed on Mar. 17, 1990.

(30) Foreign Application Priority Data

Mar. 22, 1996 (IL) ..... 117624
Sep. 6, 1996 (IL) ..... 119211

(51) Int. Cl.[7] ..... A62C 31/02
(52) U.S. Cl. ..... 239/391; 239/562; 239/568
(58) Field of Search ..... 239/391, DIG. 1, 239/562, 568, 580, 583

(56) References Cited

U.S. PATENT DOCUMENTS 5,050,800 * 9/1991 Lamar ..... 239/DIG. 1
5,083,709 * 1/1992 Iwanowski ..... 239/DIG. 1
5,556,036 * 9/1996 Chase ..... 239/DIG. 1
5,642,861 * 7/1997 Ogi et al. ..... 239/DIG. 1

* cited by examiner

*Primary Examiner*—David J. Walczak
(74) *Attorney, Agent, or Firm*—Benjamin J. Barish

(57) ABSTRACT

A static sprinkler presettable to select a desired water discharge pattern includes a lower part formed with a cavity defined by a cylindrical surface and extending axially from an inner end of the lower part serving as a water inlet through the outer end of the lower part; and an upper part carried by the lower part and having a cylindrical stem received within the cavity and engaging the cylindrical surface. The upper part is rotatably presettable with respect to the lower part to align one of a plurality of water discharge openings in one part with a passageway in the other part to thereby enable selection of the water discharge pattern of the sprinkler.

19 Claims, 10 Drawing Sheets

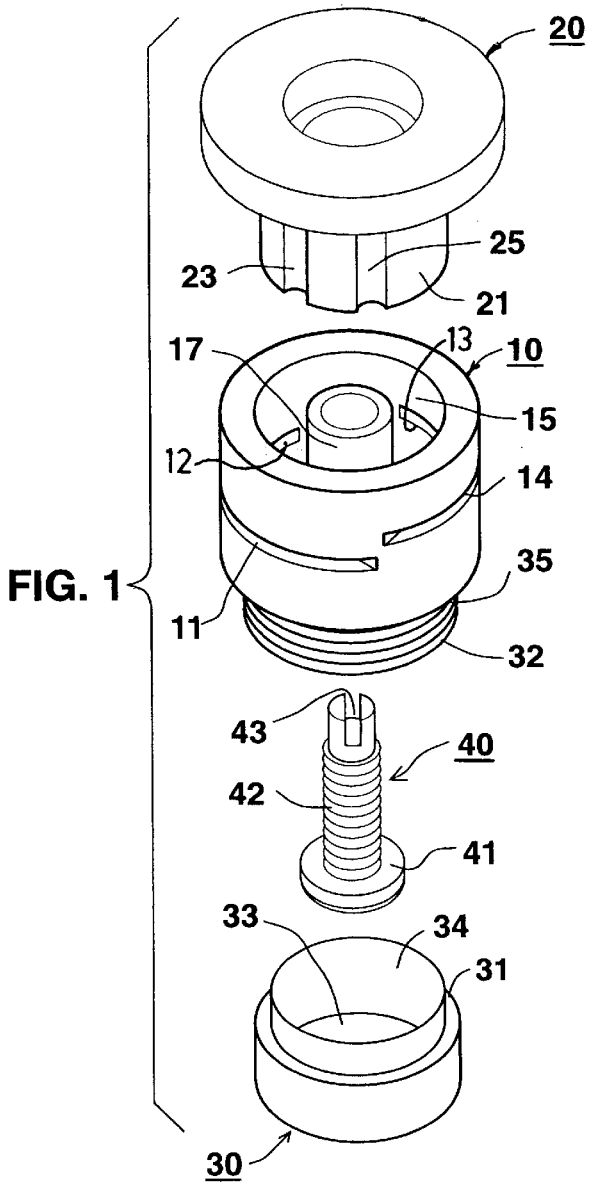
FIG. 1
FIG. 2
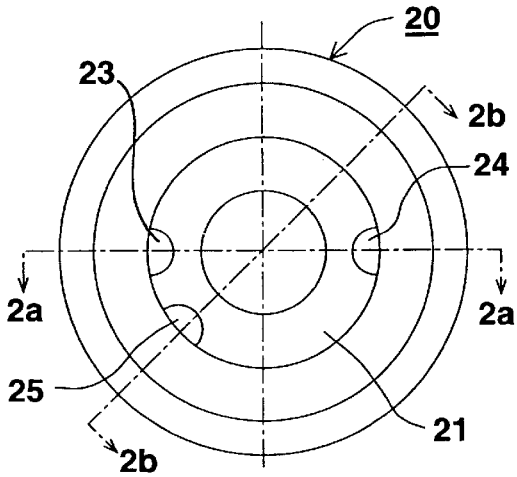
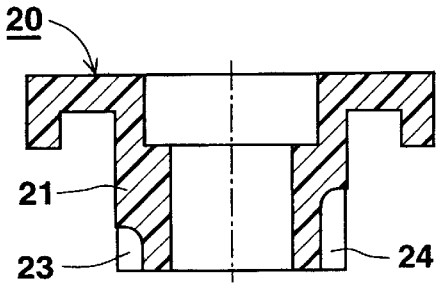
FIG. 2a
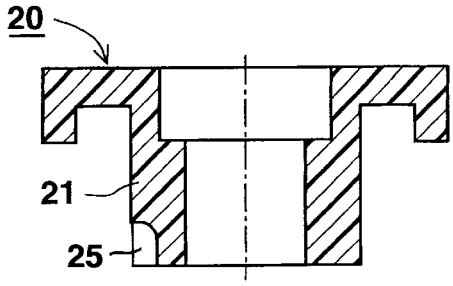
FIG. 2b

FIG. 6
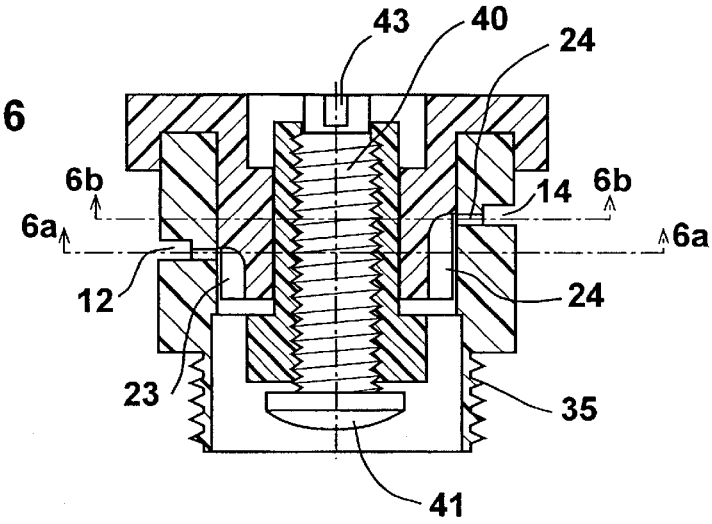
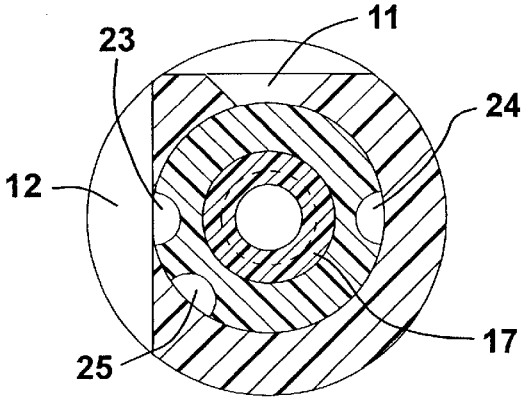
FIG. 6a
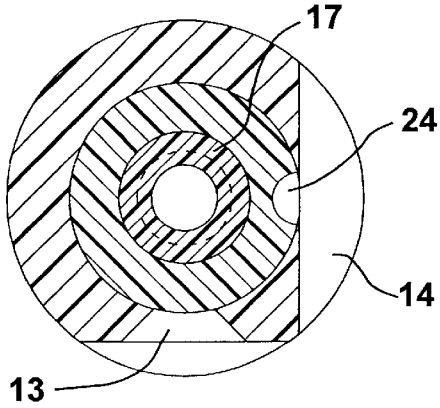
FIG. 6b
FIG. 6c
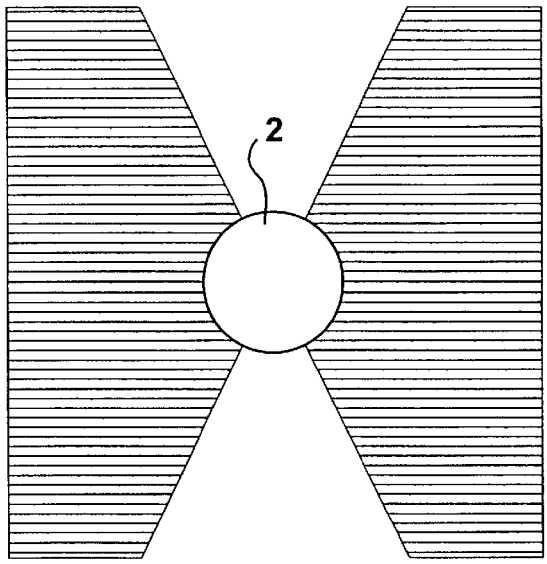

STATIC SPRINKLER WITH PRESETTABLE WATER DISCHARGE PATTERN

This Application is a continuation of PCT/IL97/00098, filed Mar. 17, 1990.

FIELD AND BACKGROUND OF THE INVENTION

The present invention relates to static sprinklers, and particularly to static sprinklers having a presettable water discharge pattern.

Static (i.e., non-rotatable) water sprinklers are constructed to provide different water discharge patterns according to the area to be wetted by the respective sprinkler in any particular irrigation system. For example, static sprinklers may be required to discharge the water in the form of wide strips on both sides of the sprinkler or only on one side, or in the form of narrow strips on both sides of the sprinkler or only on one side. While many static sprinkler constructions are known enabling presetting the sprinkler to produce a desired water discharge pattern, the known constructions generally do not permit presetting a large number of different discharge patterns, and/or require relatively complicated parts which are expensive to produce, assemble and/or maintain.

OBJECTS AND BRIEF SUMMARY OF THE INVENTION

An object of the present invention is to provide a static water sprinkler enabling it to be preset to produce a desired water discharge pattern, which sprinkler is constituted of a few relatively simple parts that can be produced and assembled in volume and at low cost. Another object of the invention is to provide a static sprinkler which permits a relatively large number of water discharge patterns to be preset.

According to a broad aspect of the present invention, there is provided a static sprinkler presettable to select a desired water discharge pattern, comprising: a first part formed with a water inlet, and a cavity defined by a cylindrical surface and extending axially from said water inlet; and a second part carried by said first part, said second part having a cylindrical stem received within said cavity, and an outer end closing said cavity; one of said parts being formed with a plurality of angularly-spaced water discharge openings communicating with said cavity, said water discharge openings being of different configurations to produce different water discharge patterns, at least one of said discharge openings producing a narrow water discharge pattern, and at least another of said discharge openings producing a wider water discharge pattern; the other of said parts being formed with at least one axially-extending passageway extending axially from said water inlet to said discharge openings in said one part; said second part and stem being rotatably presettable with respect to said first part to align said passageway of said other part with one of said water discharge openings in said one part to thereby enable selection of the water discharge pattern of the sprinkler.

Two embodiments of the invention are described below wherein the stem has an outer surface of cylindrical configuration for its major surface area engageable with the inner cylindrical surface of the cavity; and wherein the first part is a body member and constitutes the part formed with a plurality of angularly-spaced water discharge openings; and the second part is a cap and constitutes the part formed with the at least one axially-extending passageway.

A third embodiment of the invention is also described, wherein the first part is a cap and constitutes the part formed with a plurality of angularly-spaced water discharge openings, each water discharge opening being at the outer end of a passageway formed in the cap stem; and the second part is a body member and constitutes the part formed with the at least one axially-extending passageway.

According to yet additional features in the described preferred embodiments, the sprinkler may further include a base member attached to the inner end of the first part and formed with an annular flow-control surface with respect to the inlet of the sprinkler; and a screw threaded in the first part and carrying an enlarged head adjustable towards and away from the annular flow-control surface to adjust the sprinkler flow rate.

As will be described more particularly below, the foregoing features of the invention enable static water sprinklers to be constructed with a relatively few simple parts which can be produced and assembled in volume and at low cost, and which also permit a large number of different water discharge patterns to be preselected.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a three-dimensional, exploded view illustrating one form of static water sprinkler constructed in accordance with the present invention;

FIG. 2 is a bottom view of the cap in the water sprinkler of FIG. 1, FIGS. 2*a*, 2*b* being sections along lines 2*a*—2*a* and 2*b*—2*b*, respectively of FIG. 2;

FIGS. 6, 6*a* and 6*b* are corresponding views of the sprinkler when preset to produce the two-side wide strip water distribution pattern illustrated in FIG. 6*c;*

FIGS. 11–14 illustrate a third form of static water sprinkler constructed in accordance with the present invention, wherein FIGS. 11–13 are longitudinal sectional views illustrating three different preset positions of the sprinkler cap; FIGS. 11*a*–13*a* are bottom views of the upper part or cap in the three preset positions, respectively, of the sprinkler of FIGS. 11–13; and FIG. 14 is a bottom view of the lower part or body member of the sprinkler of FIGS. 11–13.

DESCRIPTION OF PREFERRED EMBODIMENTS

Figure 3:
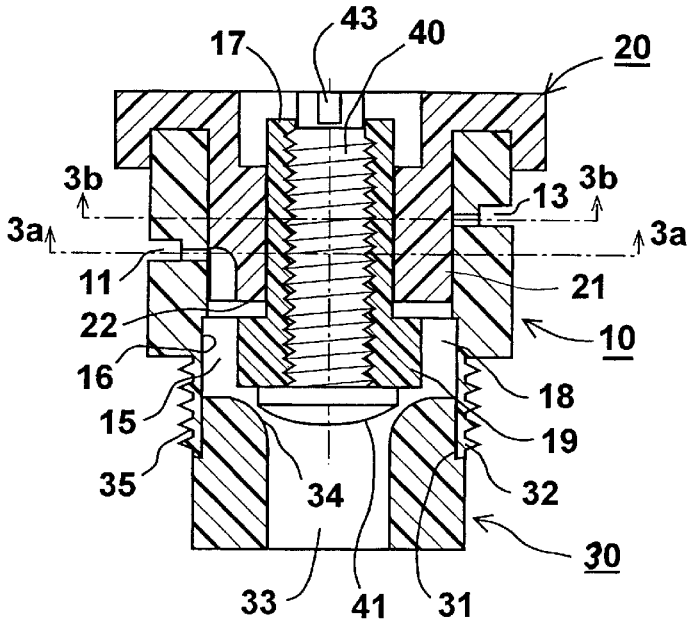
FIG. 3 is a longitudinal sectional view illustrating the assembled sprinkler of FIG. 1, and FIGS. 3*a*, 3*b* are sectional views along lines 3*a*—3*a* and 3*b*—3*b* thereof, in one presettable position of the sprinkler to produce the one-side narrow strip water discharge pattern illustrated in FIG. 3*c;*

The static water sprinkler illustrated in FIGS. 1–6 of the drawings is constituted of the following four basic components: a lower part or body member 10, an upper part or cap 20 carried at one end of the body member, a base member 30 at the opposite end of the body member, and a screw 40 threadedly received within the cap and the body member. As will be described more particularly below, these four basic components of the water sprinkler enable the sprinkler to be preset to select any one of the four water distribution patterns illustrated in FIGS. 3*c*–6*c*, respectively.

Base member 30 and the inner end of the lower part or body member 10 receiving the base member serve as the inlet to the water sprinkler. Body member 10 is formed with four water discharge openings 11, 12, 13 and 14, at its four sides through which the water may be selectively discharged according to the presetting of the sprinkler.

Figure 3A:
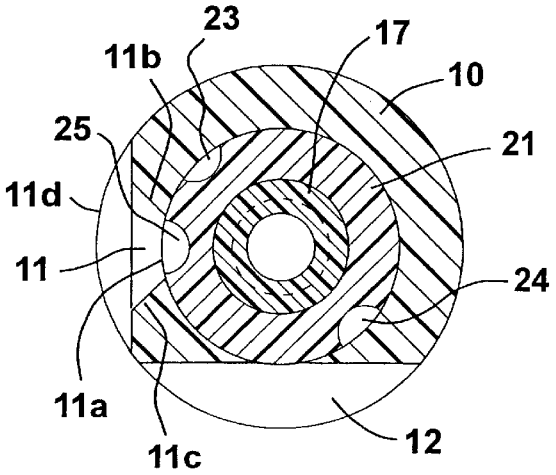
Figure 3B:
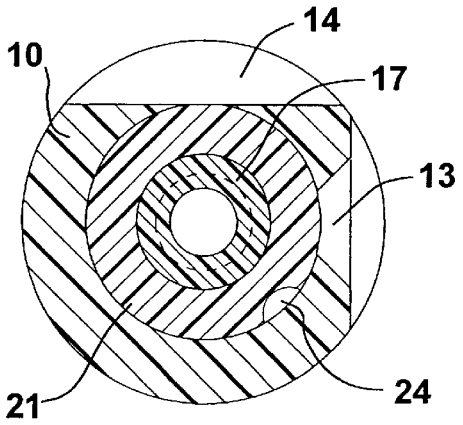
Figure 3C:
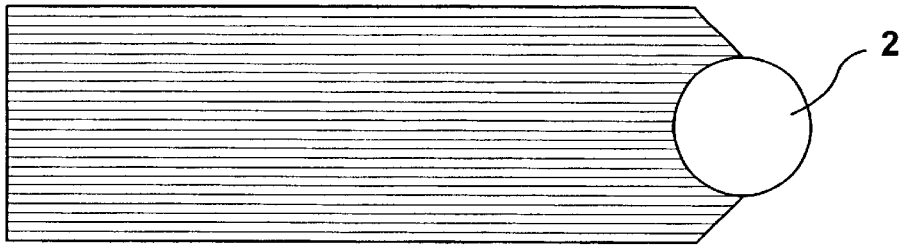

As shown for example in FIGS. 3, 3*a* and 3*b*, water discharge openings 11 and 12 are located at the same axial distance from the inner end of body member 10, but are of different configurations. Thus, opening 11 is narrow at its inner end 11*a*, has diverging surfaces 11*b*, 11*c* towards it outer end 11*d*, and is of shorter length than opening 12. Opening 11 thus produces a relatively narrow water distribution pattern, corresponding to the pattern illustrated in FIG. 3*c*. Opening 12, on the other hand, produces a wider distribution pattern, corresponding to the pattern illustrated in FIG. 5*c*.

Water discharge openings 13 and 14 in body member 10 are located a larger axial distance from the inner end of the body member than openings 11 and 12. Opening 13 is diametrically opposed to opening 11 and is of the same configuration as that opening; whereas opening 14 is diametrically opposed to opening 12 and is of the same configuration as that opening.

The four water discharge openings 11–14 in body member 10 communicate with the sprinkler inlet at the inner end of the body member via a cavity 15 formed in the body member receiving the cap 20. For this purpose, the inner surface 16 of body member 10 defining cavity 15 is of cylindrical configuration. Body member 10 further includes an internally-threaded sleeve 17 extending axially through cavity 15 for receiving adjusting screw 40, as will be described more particularly below. The inlet to the sprinkler communicates with cavity 15 via a plurality of openings 18 formed through the section 19 of the body member joining it to sleeve 17.

The upper part or cap 20 carried by body member 2 is formed with a cylindrical stem 21 received within cavity 15 of the body member. Stem 21 has an inner end 22 facing the sprinkler inlet at the inner end of body member 10, and an outer end joined to cap 20 and closing the cavity 15 at the outer end of the body member.

As shown particularly in FIGS. 2, 2*a* and 2*b*, stem 21 of cap 20 is formed with three axially-extending grooves 23, 24, 25, respectively, which serve as passageways from the inlet end of the sprinkler to a selected one of the water discharge openings 11–14 formed in the body member. Groove 23 extends a short distance axially of the stem; groove 24 is diametrically opposed to groove 23 and extends a longer axial distance; whereas groove 25 is located 45° from groove 23 and extends for the same short axial distance as groove 23. The axial distance of the short grooves 23 and 25 in stem 21 corresponds to the short axial distances of water discharge openings 11 and 12 in body member 10; whereas the axial distance of the long groove 24 in stem 21 corresponds to the longer axial distance of water discharge openings 13 and 14 in body member 10.

Base member 30 is attached to the inlet end of body member 10. For this purpose, the end of base base 30 to be attached to body member 10 is reduced in diameter on its outer surface, as shown at 31, and receives with a friction fit an annular extension 32 of the body member. Base member 30 is further formed with a axial passageway 33 which flares outwardly to define an annular surface 34 at the end attached to the body member. Annular extension 32 of body member 10 is externally threaded, as shown at 35, for attachment to a water supply pipe (not shown).

Annular surface 34 cooperates with screw 40, particularly an enlarged head 41 of that screw, to define a flow-control passageway controlling the sprinkler flow rate. Screw 40 is formed with external threads 42 cooperable with threads in sleeve 17, and with an external slot 43 for rotating screw 40, and thereby for adjusting its head 41 with respect to annular surface 34 of base member 30.

Figure 4:
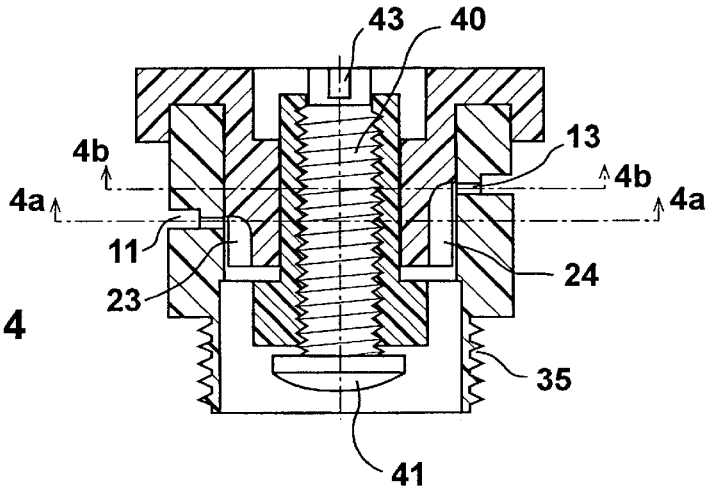
FIGS. 4, 4*a* and 4*b* are corresponding views of the sprinkler when preset to produce the two-side narrow strip narrow distribution pattern illustrated in FIG. 4*c;*
Figure 4A:
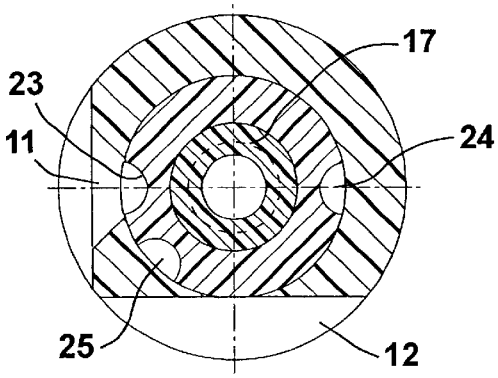
Figure 4B:
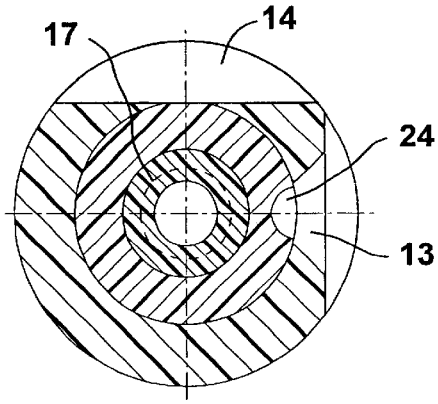
Figure 4C:
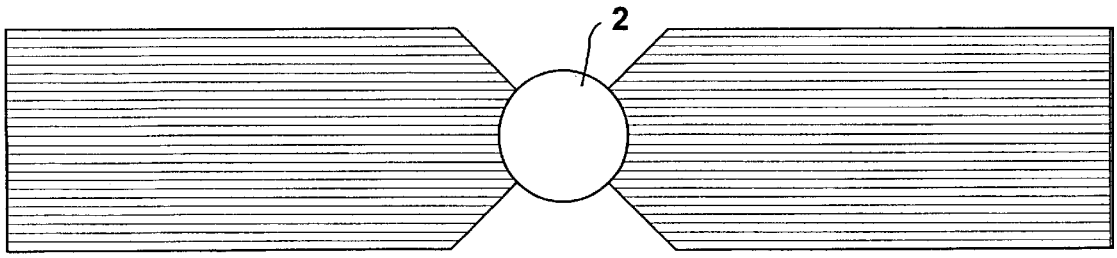
Figure 5:
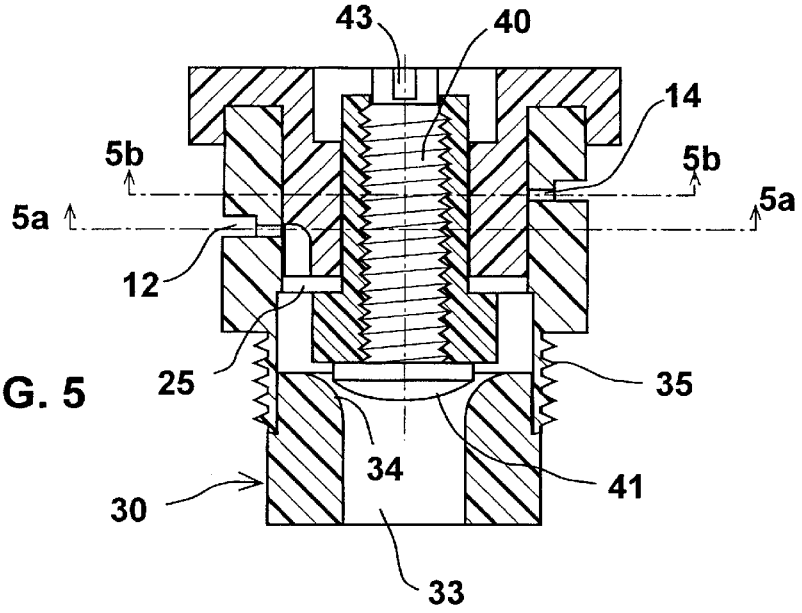
FIGS. 5, 5*a* and 5*b* are corresponding views of the sprinkler when preset to produce the one-side wide strip water distribution pattern illustrated in FIG. 5*c;*
Figure 5A:
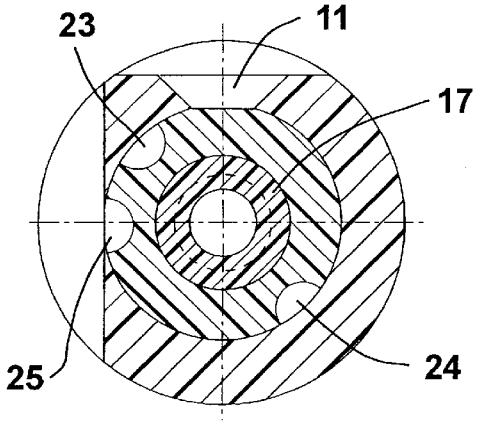
Figure 5B:
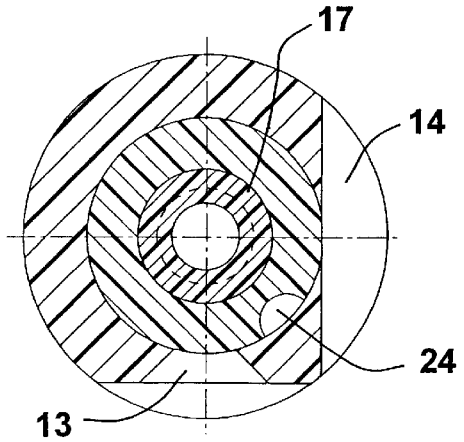
Figure 5C:
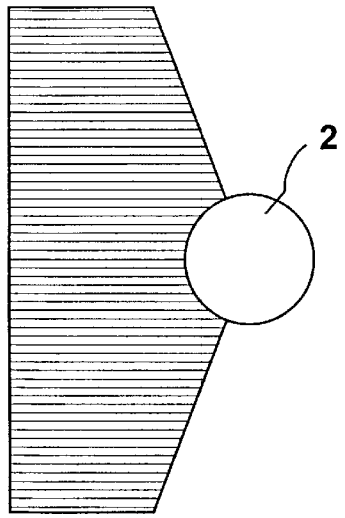

Before the sprinkler is used, it may be preset to produce the desired water discharge pattern by rotating cap 20 with respect to body member 10. Thus, when cap 20 is rotated to the position illustrated in FIG. 3, the sprinkler inlet is connected only via the short groove 25 in stem 21 to the narrow outlet 11 in the body member 10 (FIG. 3*a*) to produce the narrow discharge pattern illustrated in FIG. 3*c*. When cap 20 is rotated to the position illustrated in FIG. 4, the inlet is connected via the short groove 23 to the narrow outlet 11 (FIG. 4*a*) and via the long groove 24 to the narrow outlet 13 (FIG. 4*b*), to produce the narrow distribution pattern on both sides of the sprinkler as shown in FIG. 4*c*. When cap 20 is rotated to the position illustrated in FIG. 5, the inlet is connected only via the short groove 25 to the wide outlet 12 (FIG. 5*a*) to produce the wide discharge pattern on one side of the sprinkler as illustrated in FIG. 5*c*; and when cap 20 is rotated to the position illustrated in FIG. 6, the inlet is connected via the short groove 23 to the wide outlet 12, and via the long groove 24 to the wide outlet 14, to produce the wide distribution pattern on both sides of the sprinkler as illustrated in FIG. 6*c*.

It will also be seen that by rotating screw 40 within sleeve 17, the screw head 41 may be moved towards or away from the annular surface 34 of base member 30, to thereby preset the flow rate of the sprinkler.

Figure 7:
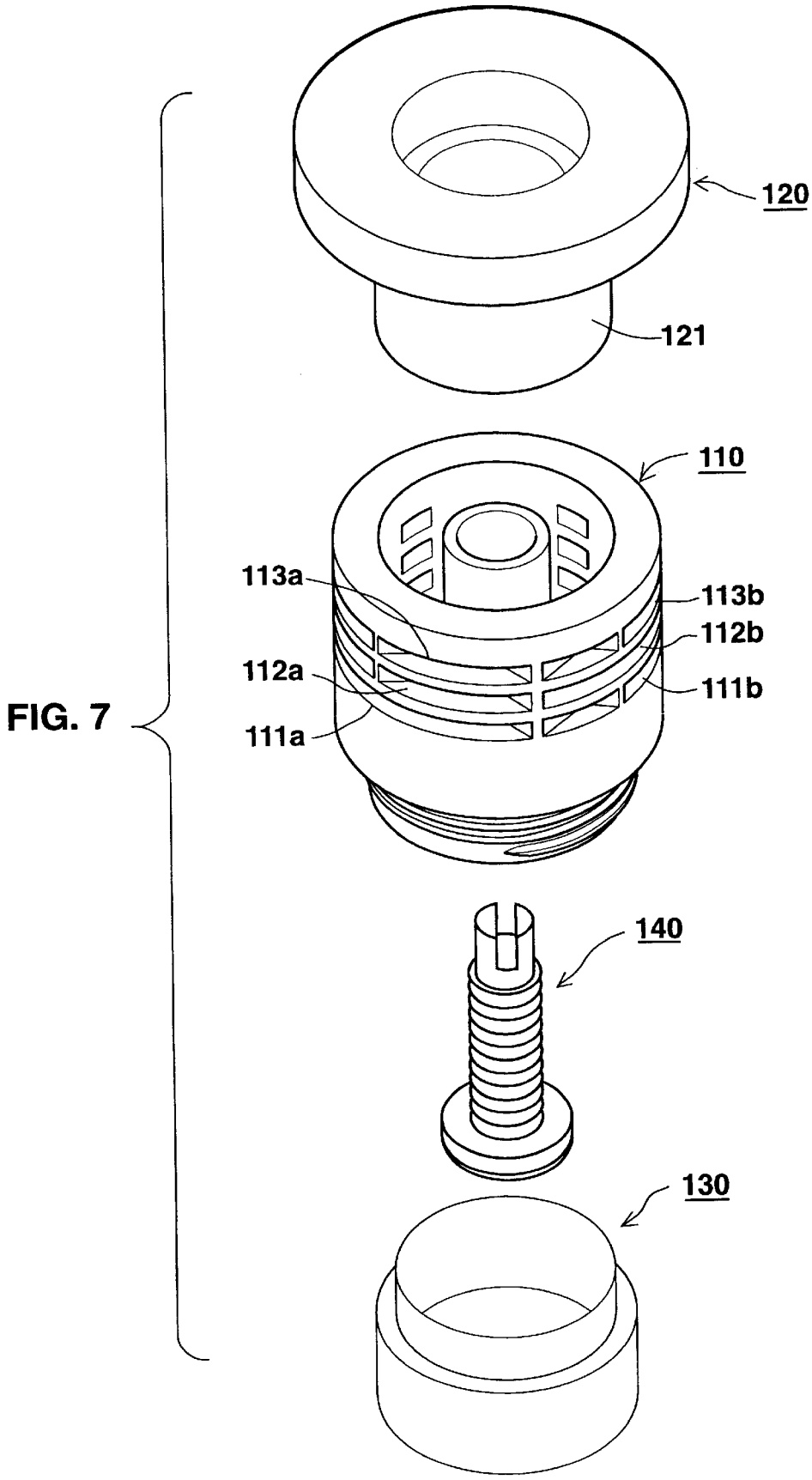
FIG. 7 is a three-dimensional, exploded view illustrating a second form of static water sprinkler constructed in accordance with the present invention.
Figure 8:
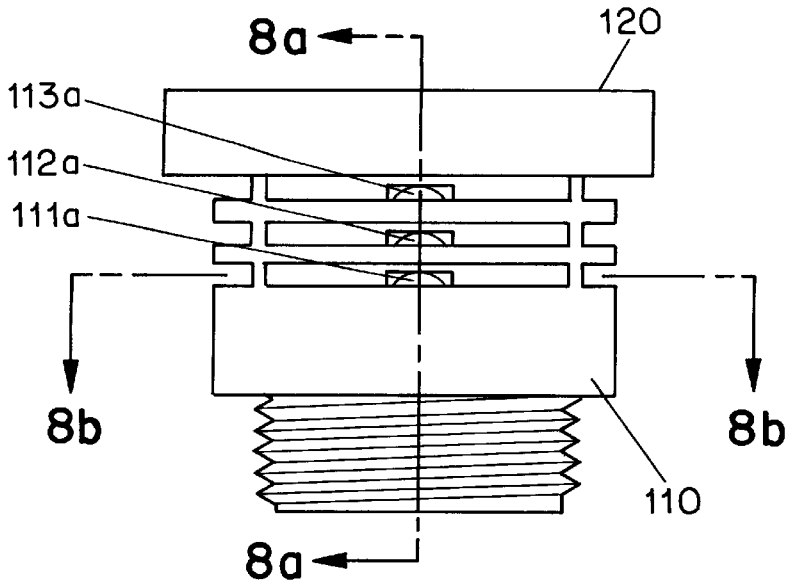
FIG. 8 is a side elevational view of the static sprinkler of FIG. 7 in assembled form, FIGS. 8*a* and 8*b* being sections along lines 8*a*—8*a* and 8*b*—8*b*, respectively, of FIG. 8.
Figure 8A:
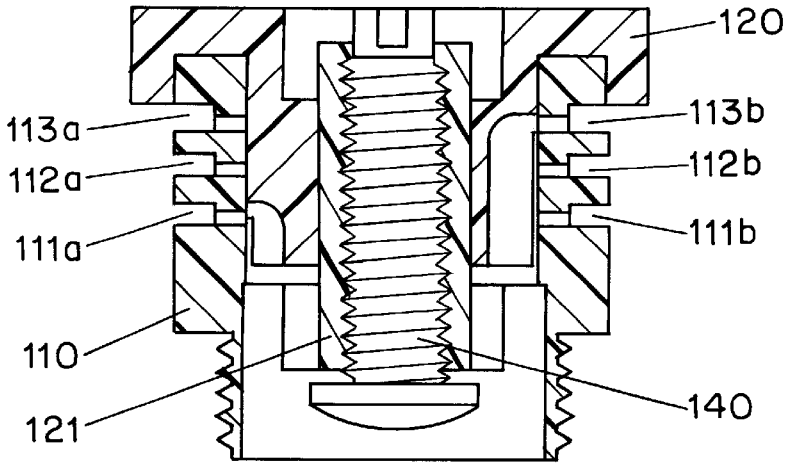
Figure 8B:
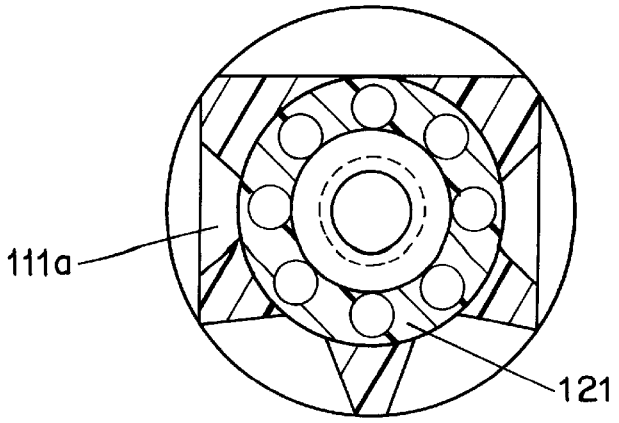
Figure 9:
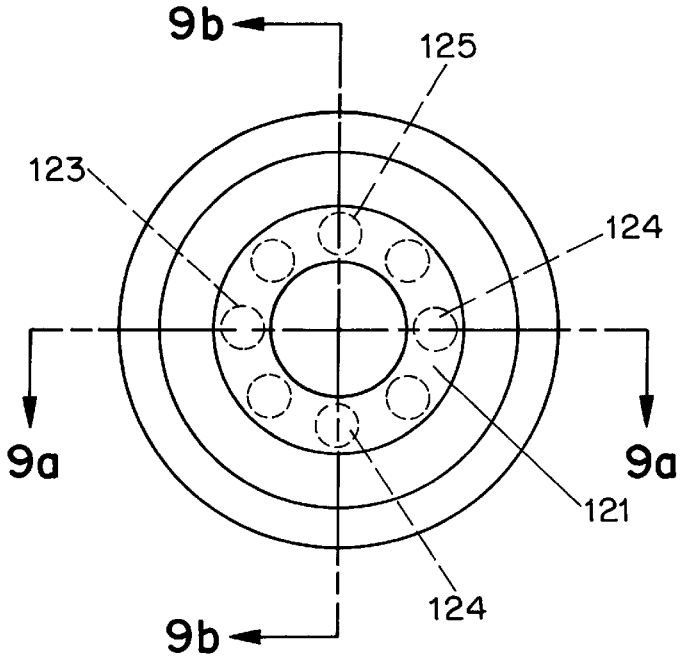
FIG. 9 is a bottom view of the cap in the water sprinkler of FIG. 7, FIGS. 9*a* and 9*b* being sections along lines 9*a*—9*a* and 9*b*—9*b*, respectively, of FIG. 9.
Figure 10:
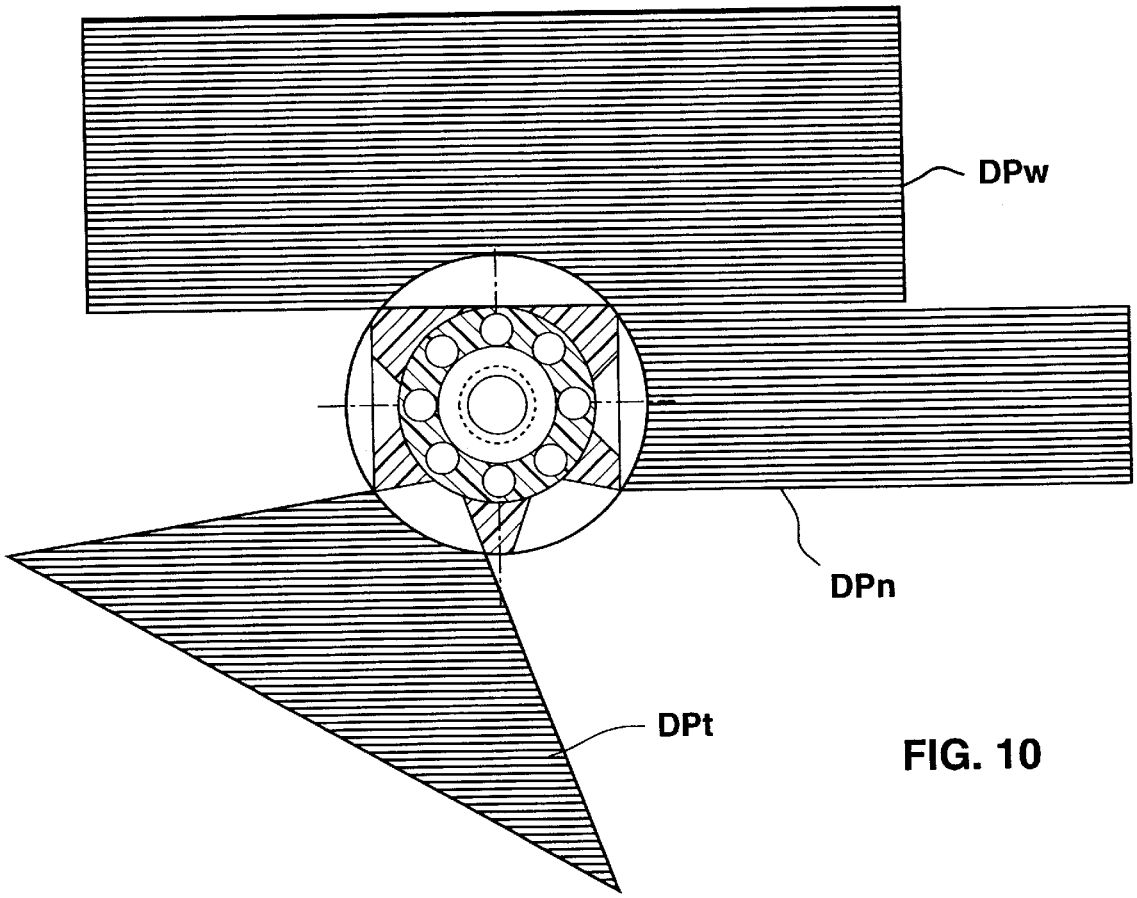
FIG. 10 illustrates another example of water discharge patterns that can be provided by the sprinkler of FIG. 7.

FIGS. 7–9 illustrate another water sprinkler constructed in accordance with the present invention which permits an even wider variety of water distribution patterns to be preselected, as exemplified by the patterns of FIG. 10.

The sprinkler of FIGS. 7–9 is also constituted of four basic components, corresponding to the four components in the sprinkler of FIGS. 1–6, namely: a lower part or body member 110, an upper part or cap 120, a base member 130, and a screw 140. These four components are of substantially the same construction as in the sprinkler of FIGS. 1–6, with the following exceptions.

Body member 110 is formed with three groups of water discharge openings at three different axial positions from the inner end of the body member. Thus, one group of water discharge openings (111*a*, 111*b*) are closest to the inner end of the body member; a second group (112*a*, 112*b*) are spaced slightly further; and a third group (113*a*, 113*b*) are spaced even further from the inner end of the body member. These water discharge openings may be of different configurations to produce different water discharge patterns. Thus, as shown in FIG. 10, some of these openings could define a narrow discharge pattern DPn and a wide discharge pattern DPw as in FIGS. 1–6, whereas other openings could define a divergeing or triangular discharge pattern as shown at DPt.

Cap 120 is formed with a stem having three different lengths of axially-extending passageways selectively alignable with the three different groups of water discharge openings in the body member; also, these passageways are axially-extending bores formed through the stem, rather than grooves formed in the outer surface of the stem as in FIGS. 1–6.

Figure 9A:
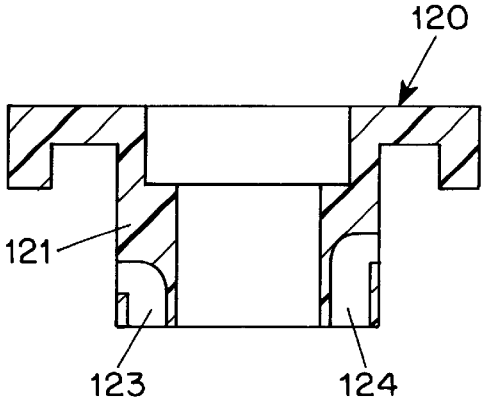
Figure 9B:
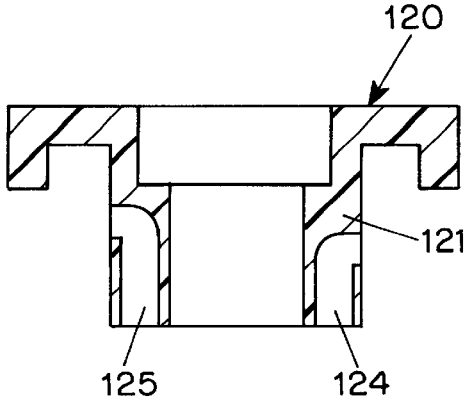

Thus, as shown particularly in FIGS. 9*a* and 9*b*, stem 121 of cap 120 is formed with a first group of short axially-extending bores 123 selectively alignable with the lower group of water discharge openings 111*a*, 111*b* in body member 110; a second group of intermediate-length bores 124 selectively alignable with the intermediate group of water discharge openings 112*a*, 112*b* in the body member; and a third group of long bores 125 selectively alignable with the highest water discharge openings 113*a*, 113*b*, formed in the body member.

It will thus be seen that by rotating cap 120 with respect to body member 110, the bores 123, 124, 125 of the cap stem 121 can be selectively aligned with the water discharge openings in body member 110 to produce any desired water discharge pattern, for example the water discharge patterns illustrated in FIG. 10.

In all other respects, the construction and mode of use of the water sprinkler illustrated in FIGS. 7–9 are the same as described above with respect to the sprinkler of FIGS. 1–6.

The sprinkler illustrated in FIGS. 11–14 is basically of the same construction as the two others described earlier, except that instead of forming the plurality of angularly-spaced water discharge openings in the lower part or body member (10 or 110), and the axially-extending passageway (or passageways) in the upper part or cap (20 or 120), the arrangement is reversed; that is, in the FIGS. 11–14 sprinkler, the water discharge openings are formed in the upper part or cap; and the axially-extending passageway (there being only one in this construction) is formed in the lower part or body member.

Thus, as shown in FIGS. 11–14, the lower part or body member 210 is formed with a single axially-extending passageway 211 leading from the inlet of the sprinkler to the cylindrical cavity 212 at the outer end of the body member. Body member 210 further includes an internally-threaded sleeve 213 extending axially through cavity 212 for receiving adjusting screw 240, corresponding to screw 40 in FIGS. 1–6. The upper part or cap 220 is formed with a cylindrical stem 221 enclosing sleeve 213 and received within cavity 212 of body member 210.

Cap 220 is formed with three water discharge openings 222, 223, 224, of different configurations. Each discharge opening is at the outer end of a passageway formed in stem 221 (as shown by passageway 222*a* for opening 222 in FIG. 11) alignable with the axially-extending passageway 211 in body member 210. The arrangement is such that by selectively rotating cap 220 to any one of the three positions illustrated in FIGS. 11–14, respectively, the axially-extending passageway 211 may be selectively aligned with one of the water discharge openings 222, 223, 224, to preselect the water discharge pattern from the sprinkler.

Figure 11:
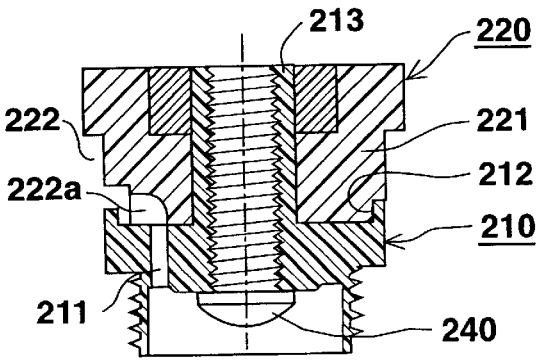
Figure 11A:
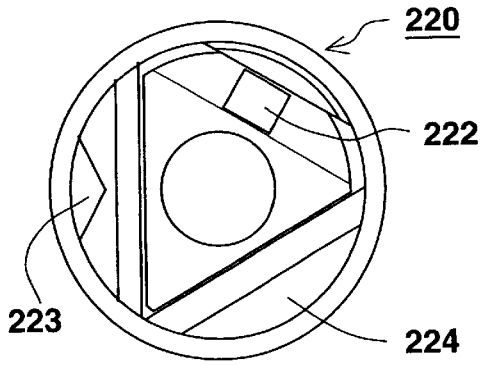
Figure 12A:
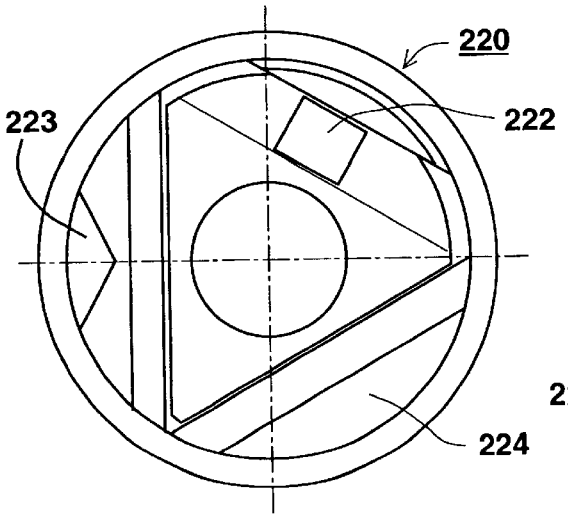
Figure 13A:
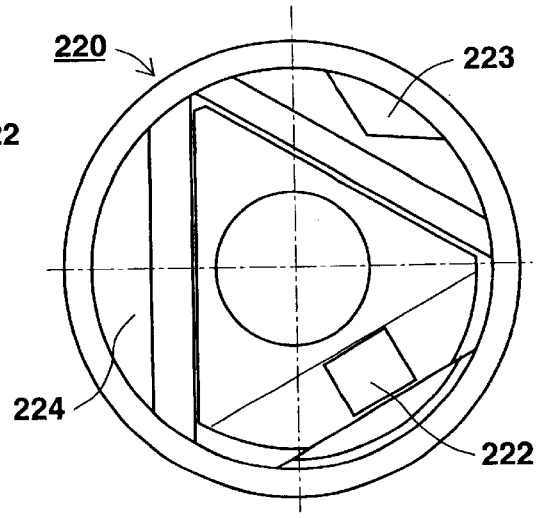
Figure 12:
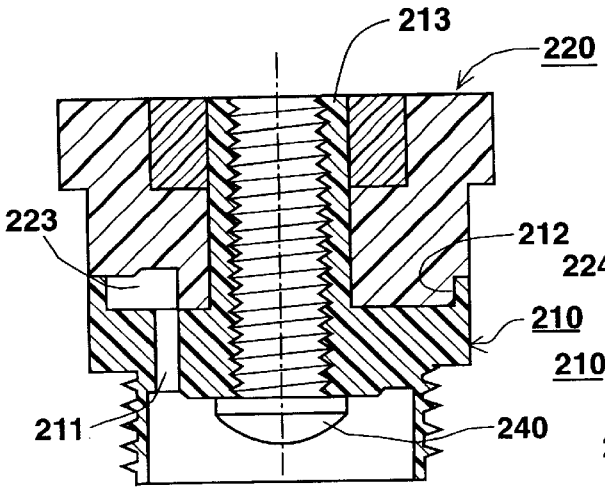
Figure 13:
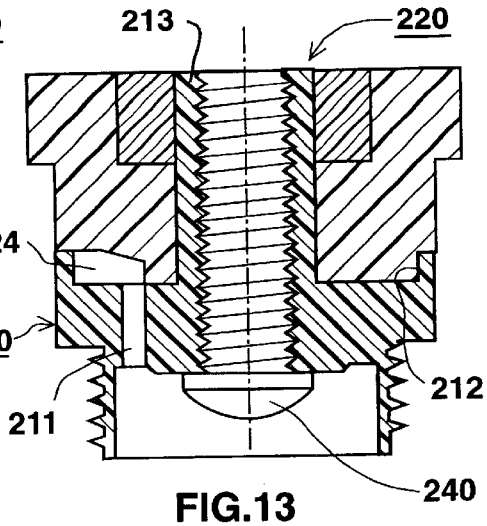
Figure 14:
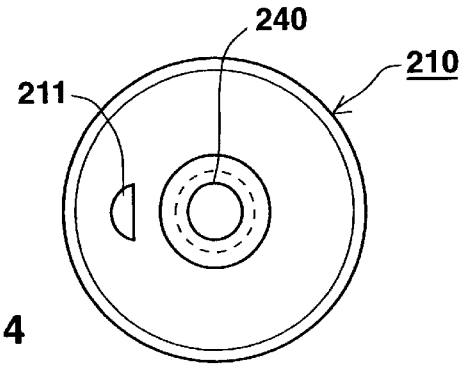

Thus, when cap 220 is in the position illustrated in FIGS. 11 and 11*a*, water discharge opening 222 of the cap is aligned with passageway 211 of body member 210 to produce a narrow discharge pattern, corresponding to pattern DPn in FIG. 10; when cap 220 is in the position illustrated in FIGS. 12 and 12*a*, its water discharge opening 223 is aligned with passageway 211 to produce a divergeing or triangular discharge pattern corresponding to pattern DPt of FIG. 10; and when cap 220 is in the position illustrated in FIGS. 13 and 13*a*, its water discharge opening 224 is aligned with passageway 211 to produce a wide discharge pattern, corresponding to pattern DPw of FIG. 10.

In all other respects, the construction and mode of use of the sprinkler illustrated in FIGS. 11–14 are the same as described above with respect to the sprinklers of FIGS. 1–6 and 7–9, respectively.

While the invention has been described with respect to three preferred embodiments, it will be appreciated that these are set forth merely for purposes of example, and that many other variations, modifications and applications of the invention may be made.

What is claimed is:

1. A static sprinkler presettable to select a desired water discharge pattern, comprising:

a first part formed with a water inlet, and a cavity defined by an inner cylindrical surface and extending axially from said water inlet;

and a second part carried by said first part, said second part having a cylindrical stem received within said cavity, and an outer end closing said cavity, said stem having an outer surface of cylindrical configuration for its major surface area engageable with the inner cylindrical surface of said cavity;

one of said parts being formed with a plurality of angularly-spaced water discharge openings communicating with said cavity, said water discharge openings being of different configurations to produce different water discharge patterns, at least one of said discharge openings producing a narrow water discharge pattern, and at least another of said discharge openings producing a wider water discharge pattern;

the other of said parts being formed with at least one axially-extending passageway extending axially from said water inlet to said discharge openings in said one part;

said second part and stem being rotatably presettable with respect to said first part to align said passageway of said other part with one of said water discharge openings in said one part to thereby enable selection of the water discharge pattern of the sprinkler.

2. A static sprinkler presettable to select a desired water discharge pattern, comprising:

a first part formed with a water inlet, and a cavity defined by an inner cylindrical surface and extending axially from said water inlet;

and a second part carried by said first part, said second part having a cylindrical stem received within said cavity, and an outer end closing said cavity;

one of said parts being formed with a plurality of angularly-spaced water discharge openings communicating with said cavity, said water discharge openings being of different configurations to produce different water discharge patterns, at least one of said discharge openings producing a narrow water discharge pattern, and at least another of said discharge openings producing a wider water discharge pattern;

the other of said parts being formed with at least one axially-extending passageway extending axially from said water inlet to said discharge openings in said one part;

said second part and stem being rotatably presettable with respect to said first part to align said passageway of said other part with one of said water discharge openings in said one part to thereby enable selection of the water discharge pattern of the sprinkler;

wherein said first part is a body member and constitutes said one part formed with a plurality of angularly-spaced water discharge openings; and said second part is a cap and constitutes said other part formed with said at least one axially-extending passageway, which passageway is formed in the stem of said cap.

3. The sprinkler according to claim 2, wherein said at least one axially-extending passageway in the stem is an axially-extending groove formed in an outer surface of said stem.

4. The sprinkler according to claim 2, wherein said at least one axially-extending passageway in the stem is an axially-extending bore formed through said stem.

5. The sprinkler according to claim 2, wherein there are a plurality of said axially-extending passageways in the stem of different lengths and selectively alignable upon rotation of the stem with a plurality of water discharge openings formed in the body member at different axial distances from the inlet of the body member to produce different discharge patterns.

6. The sprinkler according to claim 2, wherein said stem is formed with at least two of said axially-extending passageways angularly spaced from each other and selectively alignable with said water discharge openings in the body member.

7. The sprinkler according to claim 6, wherein said at least two axially-extending passageways are located at diametrically opposite sides of the stem, and said plurality of water discharge openings in the body member include two water discharge openings at diametrically opposite sides of the body member.

8. The sprinkler according to claim 7, wherein said at least two water discharge openings in the body member are at different axial distances from an inner end of the body member; and wherein said at least two axially-extending passageways in the stem are at different axial distances from an inner end of the stem corresponding to the different axial distances of the water discharge openings in the body member.

9. The sprinkler according to claim 8, wherein said water discharge openings in the body member include:

a first pair of water discharge openings at diametrically opposite sides of the body member at different axial distances from the inner end of the body member;

and a second pair of water discharge openings at diametrically opposite sides of the body member at said different axial distances from the inner end of the body member.

10. The sprinkler according to claim 9, wherein said at least two axially-extending passageways in the stem include:

a short passageway and a long passageway at diametrically opposite sides of the stem extending different axial distances from the inner end of the stem corresponding to the different axial distances of said first pair of water discharge openings of the body member from the inner end of the body member;

and a third passageway at an intermediate location between the other two passageways and extending an axial distance equal to that of the short passageway from the inner end of the stem.

11. The sprinkler according to claim 10, wherein said third axially-extending passageway is located 45° from said short passageway.

12. The sprinkler according to claim 2, wherein said body member is formed with at least three of said water discharge openings at different axial distances from the body member, and wherein said stem is formed with at least three of said axially-extending passageway of different lengths from an inner end of the stem and selectively alignable with said water discharge openings.

13. A static sprinkler presettable to select a desired water discharge pattern, comprising:

a first part formed with a water inlet, and a cavity defined by an inner cylindrical surface and extending axially from said water inlet;

and a second part carried by said first part, said second part having a cylindrical stem received within said cavity, and an outer end closing said cavity;

one of said parts being formed with a plurality of angularly-spaced water discharge openings communicating with said cavity, said water discharge openings being of different configurations to produce different water discharge patterns, at least one of said discharge openings producing a narrow water discharge pattern, and at least another of said discharge openings producing a wider water discharge pattern;

the other of said parts being formed with at least one axially-extending passageway extending axially from said water inlet to said discharge openings in said one part;

said second part and stem being rotatably presettable with respect to said first part to align said passageway of said other part with one of said water discharge openings in said one part to thereby enable selection of the water discharge pattern of the sprinkler;

wherein said second part is a cap and constitutes said one part formed with a plurality of angularly-spaced water discharge openings, each water discharge opening being at the outer end of a passageway formed in said stem; said first part being a body member and constituting said other part formed with said at least one axially-extending passageway.

14. The sprinkler according to claim 13, wherein said body member is formed with a single axially-extending passageway.

15. The sprinkler according to claim 14, wherein said single axially-extending passageway is a bore extending axially through said body member.

16. The sprinkler according to claim 14, wherein said cap is formed with three water discharge openings angularly-spaced from each other on the inner surface of said cap.

17. The sprinkler according to claim 1, wherein said plurality of water discharge openings include water discharge openings of at least three different configurations to produce at least three different water discharge patterns.

18. The sprinkler according to claim 1, wherein the sprinkler further includes:

a base member attached to an inner end of a lower part and formed with an annular flow-control surface with respect to the inlet of the first part;

and a screw threaded in said first part and carrying an enlarged head adjustable towards and away from said annular flow-control surface to adjust the flow rate into the inlet of said first part.

19. The sprinkler according to claim 18, wherein said screw is threaded within a sleeve integrally formed with said first part.

* * * * *

UNITED STATES PATENT AND TRADEMARK OFFICE

CERTIFICATE OF CORRECTION

PATENT NO. : 6,223,999 B1
DATED : May 1, 2001
INVENTOR(S) : Lemelshtrich et al.

It is certified that error appears in the above-identified patent and that said Letters Patent is hereby corrected as shown below:

Title page,
Item [56], References Cited, should read
-- U.S. PATENT DOCUMENTS:

| | | |
|---|---|---|
| 3,664,590 | Knight, | May 1972 |
| 4,085,895 | Curry et al., | April 1978 |
| 4,189,099 | Bruninea, | February 1980 |
| 5,058,806 | Rupar, | October 1991 |

FOREIGN PATENT DOCUMENTS:
Russian Federation 2,015,733 June 1991 --

Column 3,
Line 23, “it” should read -- its --

Column 5,
Line 3, “divergeing” should read -- diverging --

Column 6,
Line 2, “divergeing” should read -- diverging --
Lines 31 and 56, “angularly-spaced” should read -- angularly spaced --
Lines 39 and 65, “axially-extending” should read -- axially extending --

Column 7,
Line 7, “angularly-” should read -- angularly --
Line 9, “axially-extending” should read -- axially extending --
Lines 12 and 15, “axially-extending” should read -- axially extending --; and “axially-” should read -- axially --
Lines 18, 25, 30, 38, 54 and 66, “axially-extending” should read -- axially extending --
Lines 56 and 64, “the” (first occurrence) should read -- an --

UNITED STATES PATENT AND TRADEMARK OFFICE

CERTIFICATE OF CORRECTION

PATENT NO. : 6,223,999 B1
DATED : May 1, 2001
INVENTOR(S) : Lemelshtrich et al.

It is certified that error appears in the above-identified patent and that said Letters Patent is hereby corrected as shown below:

Column 8,
Line 5, “axially-extending” should read -- axially extending --; and “passageway” should read -- passageways --
Lines 17 and 35, “angularly-spaced” should read -- angularly spaced --
Lines 25, 40, 42 and 44, “axially-extending” should read -- axially extending --
Line 47, “angularly-” should read -- angularly --

Signed and Sealed this

Twenty-sixth Day of November, 2002

*Attest:*

*Attesting Officer*

JAMES E. ROGAN
*Director of the United States Patent and Trademark Office*